US006635610B1

(12) United States Patent
Tatsuno et al.

(10) Patent No.: US 6,635,610 B1
(45) Date of Patent: Oct. 21, 2003

(54) DETERGENT GRANULES

(75) Inventors: Teruaki Tatsuno, Osaka (JP); Richard Timonthy Hartshorn, Wylam (GB); Kevin Norwood, Cincinnati, OH (US); Paul R. Mort, III, Cincinnati, OH (US); David Scott Bohlen, West Chester, OH (US); Steven Matthew Gabriel, Cincinnati, OH (US); Rinko Katsuda, Kobe (JP); Noe Ongcoy Hidalgo, Higashinada-Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,451

(22) PCT Filed: Sep. 20, 1999

(86) PCT No.: PCT/US99/21843

§ 371 (c)(1),
(2), (4) Date: Jul. 23, 2001

(87) PCT Pub. No.: WO00/18856

PCT Pub. Date: Apr. 6, 2000

Related U.S. Application Data

(63) Continuation of application No. PCT/US98/20221, filed on Sep. 25, 1998.

(60) Provisional application No. 60/140,145, filed on Jun. 21, 1999.

(51) Int. Cl.[7] ..... C11D 1/37; C11D 11/00; C11D 17/00; C11D 17/06

(52) U.S. Cl. ..... 510/276; 510/352; 510/438; 510/446; 510/498; 510/509

(58) Field of Search ..... 510/446, 276, 510/352, 438, 498, 509

(56) References Cited

U.S. PATENT DOCUMENTS

| | | | | | |
|---|---|---|---|---|---|
| 5,009,804 | A | * | 4/1991 | Clayton et al. | 510/299 |
| 5,152,932 | A | * | 10/1992 | Mueller et al. | 510/438 |
| 5,569,645 | A | * | 10/1996 | Dinniwell et al. | 510/276 |
| 6,207,633 | B1 | * | 3/2001 | Kettenacker et al. | 510/352 |

FOREIGN PATENT DOCUMENTS

| | | | | |
|---|---|---|---|---|
| EP | 0220024 | A2 | * | 4/1987 |
| EP | 220024 | A2 | | 4/1987 |
| WO | WO96/38530 | A1 | | 12/1996 |
| WO | WO-96/38530 | A1 | * | 12/1996 |
| WO | WO98/22561 | A2 | | 5/1998 |
| WO | WO-98/23720 | A1 | * | 6/1998 |

* cited by examiner

*Primary Examiner*—Lorna M. Douyon
(74) *Attorney, Agent, or Firm*—Julia A. Glazer; Brahm J. Corstanje; Kim W. Zerby

(57) ABSTRACT

A detergent granule and tablets which comprises an anionic surfactant system which comprises an anionic sulphate surfactant and/or an anionic sulphonate surfactant and other detergent active ingredients, the granule comprising at least a first and a second particulate component and optionally a binding agent, characterised in that the ratio of anionic sulphate surfactant to anionic sulphonate surfactant in the particulate components and in the optional binding agent is less than 1:4 or more than 4:1, preferably even less than 1:5 or more than 5:1. The invention also relates to specific granules comprising restricted degree of mixing of anionic sulphonate surfactant and zeolite, anionic sulphate surfactant and carbonate salts and/or restricted degree of mixing of polymeric builder and anionic surfactant, in particular sulphate surfactants.

17 Claims, No Drawings

DETERGENT GRANULES

TECHNICAL FIELD OF THE INVENTION

This application is a 371 of PCT/US99/21843 filed Sep. 20, 1999 which is a continuation of PCT/US98/20221 filed Sep. 25, 1998 and which claims the benefit of U.S. Provisional Application No. 60/140145 filed Jun. 21, 1999.

BACKGROUND TO THE INVENTION

In order to meet consumer needs a detergent should not only provide good cleaning but the product should for example also have good aesthetics, good flow properties, good dispensing and good dissolution in the wash water. Furthermore, it is important that the same quality product and cleaning is delivered throughout the life of the product, and thus, that the product is not only stable, but also that it can be dosed uniformly in each usage.

It has been found that a more uniform dosage of detergent actives can be achieved if the actives are present in granules of a similar particle size. It has also been found that this contributes to the overall appearance of the product. In particular, it has been found that when the number of granular components of a composition is reduced and that thus for example various detergent components are incorporated in the same granule, an improved uniform dosage to the wash is obtained.

However, the inventors have found that certain detergent ingredients which are required to deliver a good cleaning performance can cause problems when mixed together in the same granule. They found in particular that the product tends to gel and leave fabric and machine residues when generally used detergent actives are mixed together to form a granule or tablet.

They found surprisingly that this occurs in particular when anionic sulphate surfactant and anionic sulphonate surfactants are formulated together. Granules containing mixtures of these surfactants tend to form gels which do not dispense or dissolve well. This not only leads to fabric residues and residues in the washing machine, but also causes that the surfactants are not efficiently or completely delivered to the wash and also that other detergent actives can become entrapped in the gelling surfactant mixture and thus not delivered to the wash effectively or completely.

The inventors have now found that when only small quantities of anionic sulphate surfactant and anionic sulphonate surfactant are mixed, or preferably not mixed at all, these problems are reduced or can even be avoided. Then, the anionic sulphonate and sulphate surfactants can both be employed in the formulations, as may be required for an improved cleaning performance and sudsing profile. They found that this can be most effectively done by formulating a detergent granule comprising different particulate components with a reduced degree of mixing of sulphonate and sulphate surfactant, or even whereby most preferably no component comprises both anionic sulphate surfactant and anionic sulphonate surfactant.

Moreover, the inventors have found that other detergent ingredients such as water-insoluble builders, inorganic salts and polymeric builders can also cause dispensing or dissolution problems depending on how they are mixed in the formulation. In particular zeolite, carbonate salts and polymeric polycarboxylates were found to cause problems. The inventors also found a way to formulate these potentially troublesome ingredients into the component of the detergent granule to optimise the dispensing, dissolution and performance of the individual detergent actives.

Thus, the present invention provides an improved method of formulating a known detergent actives, to provide overall an improved product performance, delivery, dosage and appearance.

SUMMARY OF THE INVENTION

The present invention provides a detergent granule which comprises an anionic surfactant system, comprises an anionic sulphate surfactant and/or an anionic sulphonate surfactant, and other detergent active ingredients, the granule comprising at least a first and a second particulate component and optionally a binding agent, characterised in that the ratio of anionic sulphate surfactant to anionic sulphonate surfactant in the particulate components and in the optional binding agent is less than 1:4 or more than 4:1, preferably even less than 1:5 or more than 5:1.

Preferably, no anionic sulphate and sulphonate surfactant is intimately mixed with another in the same particulate component, and thus preferably the detergent granule comprises no particulate components containing both anionic sulphate surfactant and anionic sulphonate surfactant.

This granule has been found to cause less gelling problems or less dispensing or dissolution problems and less residue problems.

The invention also provides detergent granules which comprise specific particulate components containing specific ratio's of anionic sulphonate surfactant to polymeric builder material and/or to water-insoluble builder material and the invention also provides granules comprising components comprising specific ratio's of anionic sulphate surfactant to inorganic carrier salts and/or polymeric builder material.

The invention also provides processes for making the granule of the invention and detergent compositions which substantially consist of the granule.

The components as described herein may also be present in a detergent tablet. By reducing the degree of mixing of anionic sulphate surfactant and anionic sulphonate surfactant in the components of the tablet reduced gelling and fabric residue and improved dissolution or dispensing of the tablet in the wash is achieved.

DETAILED DESCRIPTION OF THE INVENTION

The detergent granule or tablet of the invention comprises at least two particulate components, which comprise at least two detergent active ingredients. The particulate components can be defined as pre-formed particulate components, formed from the (at least two) detergent actives therein.

Suitable pre-formed particulate components may have been formed by a spray-drying, agglomeration, marumerisation extrusion or compaction process all of which methods for combining detergent ingredients are well known in the art. It may be preferred to pre-process certain ingredients via spray drying and others via agglomeration or extrusion thus, it may be particularly preferred that at least one of the pre-formed particulate components is a blown powder particle obtained from spray-drying processes, and at least one component is an agglomerate or extrudates.

Suitable spray-drying processes for forming such pre-formed particulate components are described for example in EP-A-763594 or EP-A437888. Suitable processes for forming pre-formed particulate components which are agglomerates are described for example in WO93/25378, EP-A-367339, EP-A420317 or EP-A-506184 and suitable processes for forming pre-formed particulate components by extrusion are described for example in WO91/02047.

For the purpose of the invention, the ingredients in one individual particulate components may thus be considered in an intimate mixture with another, whilst for the purpose of the invention, the ingredients from one particulate component are considered not to be in an intimate mixture with the ingredients from another particulate component.

The granule or tablet may also comprise particles which are not preformed particle components as defined herein, but for example particulate raw materials. In may be preferred that the granule or tablet comprises particulate builders, such as organic or inorganic salts or acids, in particular particulate polymeric or monomeric or polycarboxylic acids or salts thereof, silicates inorganic salts, such as alkalinity sources and filler salts and builder salts, organic and inorganic bleaching particles such as percarbonate salts and perborate salts, bleach activators, and also enzymes and perfumes. Also included are preferably effervescence components, such as organic acids and carbonate salts. However, it may be preferred that the perfumes, enzymes, but also the bleach activators and effervescence components are present as one or more pre-formed particulate components, thus containing more than one ingredient. The granule or tablet may also comprise liquid components, which can also be useful as binding agent, as described herein.

The particulate components and optionally other particulate ingredients, or raw materials (which contain no more than to active ingredients) can be formed into the granule by any known method but preferably by use of a granulation method whereby only reduced pressure or no additional pressure is used.

The particulate components as described herein should thus preferably be mixed in such a manner that the ingredients of one component are not formed into an intimate mixture of the ingredients of the other component. Thus preferably the component should not be mixed in such a manner that they form one component, but such that substantially all ingredients in the core of each particulate component, more preferably in the component as a whole, remain in that particulate component.

To achieve this, it is preferred to use a process whereby a moderate or low sheer mixer is used. Thus, higher sheer mixers such as the Lodige CB mixer may be used, but preferably mixers of lower sheer are used, hereinafter described as low or moderate sheer mixers.

In a preferred process for making the granule of the invention, a first feed stream of detergent ingredients, which may contain one or more of the particulate components, is fed into the mixer and in addition a second feed stream detergent ingredients, which may contain one or more of the particulate components is fed into the mixer preferably a binding agent is also present in the mixer. The binding agent may be fed directly via a third stream into the mixer or it may be contacted with particulate components and other ingredients prior to one or both of these feed streams entering the mixer. Where the mixer Is divided into different zones, the three components may be fed into the same zone or optionally may be fed into different zones. In a preferred process, the particulate will be pre-mixed prior to addition of the binding agent.

The moderate to low shear mixer to be used to make the granule or the tablet herein may be for example a Lodige KM (trademark) (Ploughshare) moderate speed mixer, or mixer made by Fukae, Draes Schugi or similar brand mixers which mix with only moderate to low shear. The Lodige KM (ploughshare) moderate speed mixer which is a preferred mixer for use in the present invention comprises a horizontal hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft which preferably operate at about 3600 rpm. Other mixers similar in nature which are suitable for use in the process include the Lodige Ploughshare™ mixer and the Drais® K-T 160 mixer. Generally, the shear will be no greater than the shear produced by a Lodige KM mixer with the tip speed of the ploughs below 10 m/s, or even below 8 m/s or even lower.

Preferably, the mean residence time of the various starting detergent ingredients in the low or moderate speed mixer is preferably in range from about 0.1 seconds to about 30 minutes, most preferably the residence time is about 0.1 to about 5 minutes. In this way the density of the resulting detergent agglomerates is at the desired level.

Other suitable mixers are low or very low shear mixers such as rotating bowl agglomerators, drum agglomerators, pan agglomerators and fluid bed agglomerators.

Fluid bed agglomerators are particularly preferred. Typical fluidised bed agglomerators are operated at a superficial air velocity of from 0.1 to 3 m/s, either under positive or negative pressure. Inlet air temperatures generally range from −10 or 5° C. up to 250° C. However inlet air temperatures are generally below 200° C., or even below 150° C. The fluidized bed granulator is preferably operated such that the flux number FN of the fluid bed is at least about 2.5 to about 4.5. Flux number ($FN_m$) is a ratio of the excess velocity ($U_e$) of the fluidisation gas and the particle density ($p_p$) relative to the mass flux ($q_{liq}$) of the liquid sprayed into the bed at a normalized distance ($D_o$) of the spraying device. The flux number provides an estimation of the operating parameters of a fluidized bed to control granulation within the bed. The flux number may be expressed either as the mass flux as determined by the following formula:

$$FN_m=\log_{10}[\{P_pU_e\}/q_{liq}]$$

or as the volume flux as determined by the formula:

$$FN_x=\log_{10}[\{U_e\}/q_{vliq}]$$

where $q_{vliq}$ is the volume of spray into the fluid bed. Calculation of the flux number and a description of its usefulness is fully described in WO 98/58046 the disclosure of which is herein incorporated by reference.

In addition, the fluidized bed is generally operated at a Stokes number of less than about 2. or even less than about 1, more preferably from about 0.1 to about 0.5. The Stokes number is a measure of particle coalescence for describing the degree of mixing occurring to particles in a piece of equipment such as the fluid bed. The Stokes number is measured by the formula:

$$\text{Stokes number}=4pvd/9u$$

wherein p is the apparent particle density, v is the excess velocity, d is the mean particle diameter and u is the viscosity of the binder. The Stokes number and a description of its usefulness is described in detail in WO 99/03964, the disclosure of which is herein incorporated by reference.

Thus, where the mixer is a fluid bed mixer, detergent particulate components and other particulate ingredients of the granule or tablet of the are passed into a fluid bed optionally having multiple internal "stages" or "zones". A stage or zone is any discrete area within the fluid bed, and these terms are used interchangeably herein. The process conditions within a stage may be different or similar to the other stages in the fluid bed/dryer. It is understood that two adjacent fluid beds are equivalent to a single fluid bed having multiple stages. The various feed streams of particulate components and other ingredients can be added either at the same or at the different stages, depending on, for example, the particle size and moisture level of the feed stream. Feeding different streams to different stages can minimize the heat load on the fluid bed, and optimize the particle size and increase uniformity of the shape of the detergent granules produced.

The bed is typically fluidized with heated air in order to dry or partially dry moisture such as the binder liquids from the ingredients in the fluid bed. Where binding agent is sprayed into the fluid bed the spraying is generally achieved via nozzles capable of delivering a fine or atomized spray of the binding agent to achieve intimate mixing with the particulate components and optionally other ingredients. Typically, the droplet size from the atomizer is less than about 2 times the particle size. This atomization can be achieved either through a conventional two-fluid nozzle with atomizing air, or alternatively by means of a conventional pressure nozzle. To achieve this type of atomization, the solution or slurry rheology is may have a viscosity of less than about 500 centipoise, preferably less than about 200 centipoise at the point atomization. While the nozzle location in the fluid bed may be in most any location, the preferred location is a positioning that allows a vertical down spray of any liquid components such as binder. This may be achieved for example, using a top spray configuration. To achieve best results, the nozzle location is placed at or above the fluidized height of the particles in the fluid bed. The fluidized height is typically determined by a weir or overflow gate height. The agglomeration/granulation zone of the fluid bed may be followed by an optional coating zone, followed by a drying zone and a cooling zone. Of course, one of ordinary skill in the an will recognise that alternative arrangements are also possible to achieve the resultant particles of the present invention.

Typical conditions within a fluid bed apparatus of the present invention include: (i) a mean residence time from about 1 to about 20 minutes, (ii) a depth of unfluidised bed of from about 100 to about 600 mm, (iii) a droplet spray size of 2 times the mean particle size in the bed, which is preferably not more than about 100 micron more preferably no more than 50 microns, (iv) spray height generally from 150 to 1600 mm of spray height from the fluid bed plate or preferably 0 to 600mm from the top of the fluid bed, (v) from about 0.1 to about 4.0 m/s, preferably 1.0 to 3.0 m/s of fluidizing velocity and (vi) from about 12 to about 200 ° C. of bed temperature, preferably 15 to 100° C. Once again, one of ordinary skill in the art will recognise that the conditions in the fluid bed may vary depending on a number of factors.

The detergent granules of the invention, preferably produced in such a low or mediate sheer mixer, can be further processed by adding a coating agent to improve the particle colour, increase the particle whiteness or improve the particle stability and/or flowability after the detergent particles exit the mixer or the dryer if an optional drying step is added subsequently to the mixer or in a later stage in the mixer. Such an optional processing step may (also) includes continuously adding a coating agent such as zeolite and fume silica to the mixer to facilitate free flowability of the resulting detergent particles and to prevent over agglomeration. Such coating agents generally have a mean particle size below 100 microns, preferably below 60 microns, even more preferably below 50 microns. Other or additional coating agents include any convention coating agents used to form a protecting layer, to protect the ingredients against moisture light or temperature or external reagents, including inorganic salts, and also additional binding agents, brighteners, disintegration aids, dyes, speckles and other colorants or whitening agents and perfumes.

To form the granule or tablet of the invention, the preformed particulate components may be added in their wet or dry states for example, it is common in formation of detergent granules or tablets that initially the particulate components are wet and undergo a drying stage. The wet state will then aid the formation of the granule or tablet of the invention, by binding the particulate components (and optionally other ingredients) together. In the present invention, the pre-formed particulate component or components may be such a pre-formed particulate before it has undergone a drying stage, so that in a preferred embodiment it is in a form which could be described as a wet agglomerate, wet extrudate or wet blown powder. Generally this means that a solvent or binding agent for the processing is present in too high an amount. Such a solvent will then preferably contain water; the particulate component may then have a water content for example up to 35%, preferably up to 25% or even up to 15% by weight of the component. Often however, the particulate component will already have undergone a drying step prior to formation of the granule or tablet herein, so that the water content may be example up to 20%, preferably up to 15% or even up to 10% or even up to 5% by weight of the component.

It may be more preferred to use dry, or already dried or partially dried particulate components to form the granule or tablet of the invention, and to use therefore a binding agent. Generally such a binding agent will comprise a liquid or will be in a liquid or viscous form at the processing temperature. The binding agent will generally be added by spraying either directly into a mixer or vessel containing the particulate component or components of the granule or tablet of the invention, or onto the particulate component or components as they are introduced in the mixing step. The binding agent is added for purposes of enhancing granulation or agglomeration by providing a binding or sticking agent for detergent components and other particulate ingredients of the granule or tablet.

The binding agent is preferably selected from the group consisting of water, anionic surfactants, nonionic surfactants, polyethylene glycol, polyvinyl pyrrolidone and derivatives thereof, polyacrylates/maleates, organic acids or their salts such as citric acid or citric salts, and mixtures thereof. Other suitable binding agent including those listed herein are described in Beerse et al, U.S. Pat. No. 5,108,646 (Procter and Gamble Company), the disclosure of which is incorporated herein by reference.

If anionic surfactant is present in the binding agent, it preferably comprises one or more anionic sulphate surfactant and is free of anionic sulphonate surfactants. Preferred may be mixtures of branched and linear alkyl sulphates.

Nonionic surfactants, whilst good binding agent may not be preferred in every execution, because they may cause gelling and dispensing problems when contacted with water. In fact, in a preferred embodiment of the invention the granule or tablet comprises less than 3% or even less than 3% or even less than 1% or even 0% of nonionic surfactants, to help reduce dispensing or dissolution problems. Due to the excellent performance of the anionic surfactants, when formulated according to the invention, the reduction or elimination of the nonionic surfactants has no negative impact on the cleaning performance of the granule or tablet of the invention.

The tablets of the invention can be made by any method known in the art. In general, the individual particulate components and optional other ingredients and optionally binding agents are mixed by any of the steps described above, to form a mixture which is then formed into a tablet. It may be preferred that the tablet is made under limited pressure and that optionally a coating or binder is used to form a stable tablet. This will ensure a reduced mixing of the ingredients of one component with ingredients of another component.

The weight mean particle size of the detergent granule of the invention will generally be from 300–2000 microns, preferably being at least 500 microns, more preferably being at least 600 microns. The mean particle size will generally be below 1700 microns or even below 1500 or even below 1300 microns. This weight mean particle size can for example be determined by sieve analysis, for example by sieving a sample of the particulate relevant material herein through a series of sieves, typically 5, with meshes of various diameter or aperture size, obtaining a number of fraction (thus having a particle size of above, below or between the mesh sizes of the used sieve sizes), whereof the weight is determined (weight fractions) and then calculating the weight mean particle size Preferably at least 70% or even at least 80% by weight of said granule has a particle size from 300 to 3000 microns, or even at least 70% or even 80% by weight of said granule has a particle size from 400 to 2000 microns, or even at least 70% or even 80% by weight of said granule has a particle size from 500 to 1500 microns.

The density of the granule according to the invention will generally be above 300 g/l, preferably greater than 400 g/l or even greater than 450 g/l or even about or greater than 500 g/l.

The detergent granule can be incorporated in any detergent composition, preferably laundry detergents. Highly preferred is that the detergent granule comprises the majority of the detergent actives of a fully formulated detergent and that the granule from about 60% or even 70% or even 80 or 90% or more of the fully formulated detergent composition. It may even be preferred that the granule forms about 100% or the detergent composition.

Particulate Components

The detergent granule or tablet comprises at least two particulate components comprising more than one detergent active.

The detergent granule or tablet preferably comprises both anionic sulphate surfactant and anionic sulphonate surfactant, described herein. Then, the ratio of the sulphate to the sulphonate surfactant in one single component should be less than 1:4, or even less than 1:5, or more than 4:1, or even more than 1:5.

It has been found that the reduction of the degree of mixture of sulphate surfactant and sulphonate surfactant is in particular advantageous when the sulphate surfactant is an alkyl sulphate surfactant or branched alkyl sulphate surfactant. Thus, alkoxylated alkyl sulphates may be mixed with sulphonate surfactant in higher ratio's, for example 4:1 to 1:4, than the alkyl or branched alkyl sulphate surfactants.

Preferably the ratio is even less than 1:6 or even less than 1:7, or more than 6:1 or even more than 7:1, or more preferably less than 1:10 to more than 10:1, or even less than 1:15 or more than 15:1. However, preferably there are no component in the granule or tablet of the invention which comprise both anionic sulphate surfactant and anionic sulphonate surfactant.

Thus, it is highly preferred that at least one particulate component comprises an anionic sulphonate surfactant and another detergent active ingredient and that at least another component comprises an anionic sulphate surfactant and another detergent active ingredient.

Alternatively, or in addition hereto, the anionic sulphate surfactant and/or the anionic sulphonate surfactant may each be present as separate ingredients. For example the alkyl sulphate surfactant or part thereof, may be present as a binding agent to bind the particulate components to form the granule or tablet, provided that the above ratio's are fulfilled in respect to the binding agent. Then, preferably no anionic sulphonate surfactant is present in the binding agent.

Also, the anionic sulphate surfactant, but in particular the anionic sulphonate surfactant may be present as a particle consisting essentially of said sulphate or sulphonate surfactant, for example in the form of a granule or flake or extrudate of said surfactant. 'Consisting essentially of' means that the particle comprises at least 80% or even at least 90% by weight of the particle of the respective surfactant. The particles can thus contain very small amounts of ingredients which are for example introduced by the process for making the particles, in particular these can include water and salt.

Highly preferred is that the detergent granule or tablet of the invention comprises at least a first particulate component containing the anionic sulphonate surfactant or part thereof, and a carrier material, and comprises a second particulate component comprising the anionic sulphate surfactant or part thereof, and a carrier material.

The anionic sulphate surfactant is preferably a mixture of sulphate surfactants, preferably at least one linear alkyl sulphate surfactant and at least one branched alkyl sulphate surfactant, as described herein after. The ratio of linear to branched alkyl sulphates is preferably from 1:10 to 10:1, or more preferably from 1:5 to 5:1, preferably from 1:3 to 1:1. Highly preferred may be that a premix of linear and branched alkyl sulphates is used to make a particulate component or to from (part of) the binding agent, preferably being in the form of a paste, wherein the ratio of linear to branched alkyl sulphate is from 1:5 to 5:1, preferably from 1:3 to 1:1, most preferably from about 2:3.

The particulate component of the granule or tablet herein preferably comprise a binding material and a carrier material. This binding material (not necessarily comprising the same material as the binding agent as defined herein) can be any ingredient capable of binding or sticking particles together, such as the anionic surfactants herein, but the other materials described above, in particular polyethylene glycols, polyvinyl acetyl amines, polyacrylates an/or maleates, polyvinyl pyrrolidones and derivatives thereof, or mixtures thereto.

The carrier material can be any particulate ingredient. Useful particulate raw materials including inorganic or organic acids or salts and builder materials such a silicates. In particular useful carrier materials include sulphate salts, carbonate salts, bicarbonate salts, inorganic peroxygen salts, organic carboxylic acids and salts thereof, amorphous silicates, crystalline (layered silicates, aluminosilicates and mixtures thereof.

The inventors have also found that improved dissolution and dispensing and reduced fabric residue formation can be achieved, when the degree of mixing of anionic surfactant, in particular anionic sulphate surfactant, and inorganic carrier salts, in particular carbonate salts, is reduced. Thus, to further reduce fabric residue problems, and to further improve dissolution and dispensing, the particulate components of the granule or tablet herein preferably include a component wherein the ratio of the anionic sulphate surfactant to the inorganic salts in a component is less than 1:5 or more than 5:1, or even less than 1:6 or even more than 6:1 or even more preferably more than 10:1. This is in particular the case for carbonate salts. Highly preferred may be that a component comprising alkyl sulphate surfactant is substantially free of inorganic carbonate salts.

Thus, it may be preferred to incorporate part or all of the inorganic carbonate salt, if its presence is required in the granule or tablet, into a particulate component comprising anionic sulphonate surfactant, but only very small amounts or preferably no sulphate surfactant, within the ratio limitations set out above.

The inventors have also found that improved dissolution and dispensing and reduced fabric residue formation can be achieved, when the degree of mixing of anionic surfactant, in particular anionic sulphonate surfactant, and water-insoluble builder materials, in particular zeolite, is reduced. Thus, to furthers reduce fabric residue problems, and to further improve dissolution and dispensing, it is also preferred that when a first particulate component comprising an anionic surfactant, but in particular a sulphonate, the carrier material comprises only limited amounts of water-insoluble builder. Examples of water-insoluble builders as defined herein include silicates such as amorphous silicates, crystalline layered silicates and aluminosilicates.

Thus, it may be preferred that when water-insoluble builder material, is present in the component, the ratio of the anionic sulphonate surfactant to the water-insoluble builder in said component is less than 1:5 or more than 5:1, or even less than 1:6 or more than 6:1 or even less than 1:7 or more than 7:1. It may even be preferred that no component of the granule or tablet herein comprises both anionic sulphonate surfactant and water-insoluble builder material, in particular no aluminosilicate. Hereby, a further improved dispensing and dissolution of the deterrent ingredients can be achieved.

The granule or tablet may comprise in a preferred embodiment, a polymeric builder material. Preferred examples are described hereinafter.

The inventors have also found that improved dissolution and dispensing and reduced fabric residue formation can be achieved, when the degree of mixing of anionic surfactant, in particular anionic sulphate surfactant, and polymeric builder materials, in particular polymeric polycarboxylic acids or salts thereof, is reduced.

Thus, for the present invention, it may then be highly preferred that only small amount or preferably no polymeric builder material is present in a particulate component comprising anionic surfactant, but in particular, anionic sulphate surfactant.

This is found to be in particular advantageous if the polymeric builder material is an copolymer of maleic/acrylic acid or polyacrylate polymer, in particular when having an average molecular weight of more than 3000 or even more than 4000 or even as much as up to 15,000 or even up to 80,000.

Thus, the polymeric builder material can be in a particulate component or binding agent together with the polymeric builder but hereby it is preferred that the ratio of the anionic sulphate surfactant, or even any anionic surfactant, to polymeric builder material is less than 1:3 or more than 3:1, preferably less than 1:4. Even more preferably, the ratio of sulphate surfactant to polymeric builder material in one component or in the binding agent is less than 5:1 or more than 1:5 or even less than 7:1 or more than 1:7. Preferably the ratio of sulphonate surfactant to polymeric builder material in one component is less than 3:1 or more than 1:3 or even less than 4:1 or more than 1:4. It may be beneficial that no polymeric builder is present in a component comprising alkyl sulphate surfactant. Thus, polymeric builder material may be preferably incorporated in the granule or tablet as a separate ingredient, or in a component containing no anionic sulphate surfactant, or even more preferably in components containing substantially no anionic surfactant.

The granule or tablet comprises preferably from 0.5% to 50% by weight of sulphonate surfactant, preferably from 0.5% to 25% or even from 1.0% to 15% or even form 1.5% to 10% or even up to 6% by weight of the granule or tablet.

The granule or tablet comprises preferably from 0.5% to 60% by weight of sulphate surfactant, preferably from 1.0% to 45% or even from 3.0% to 25% or even from 5% to 20% or even from 10% to 18% by weight of the granule or tablet.

The granule or tablet comprises preferably from 1.0% to 70% by weight of water-insoluble builder, in particulate aluminosilicates such as zeolite, and crystalline layered silicates such as SKS-6, more preferably from 1.0% to 60% or even from 5.0% to 50% or even from 10% to 45% by weight of the granule or tablet.

The granule or tablet may comprise from 0.5% to 50% by weight of polymeric builder material, more preferably from 1.0% to 35% or even from 3.0% to 25% or even from 7% to 20% 20, by weight of the granule or tablet.

The granule or tablet may comprise from 0.5% to 70% by weight of inorganic salts, including alkalinity sources, more preferably from 2.0% to 60% or even from 3.0% to 50% or even from 5% to 40% by weight of the granule or tablet.

The granule or tablet comprises preferably from about 5% or even 10% to 90% or even 80% by weight of a first component comprising anionic sulphonate surfactant, more preferably from 20% to 70% or even from 25% to 65% by weight.

The granule or tablet comprises preferably also from about 5% or even 10% to 90% or even 80% by weight of a second component comprising anionic sulphate surfactant, more preferably from 20% to 70% or even from 25% to 65% by weight.

In a preferred execution of the invention, the components of the granule comprise at least a first component is a blown powder, preferably made by spray drying and at least a second component made by agglomeration or extrusion or compaction, preferably agglomeration.

The particle size of the particulate component will depends on the requirements and in particular the component and the particle size of the final granule. Generally the components have a particle size above 30 microns, preferably 60% or even 80% has a particle size of more than 50 microns or even more than 100 or even 150 microns. It may be preferred that the particle size of the particulate components is such that at least 60% or even at least 80% has a particle size of more than 250 microns or even more than 300. The maximum particle size will be determined by the particle size of the final granule, preferably being at least half the particle size of the final granule.

The bulk density of the first and second particulate components will generally differ, usually by at least 25 g/l, or even by at least 50 g/l or at least 75 g/l. The bulk density of the first and second particulate components, respectively is generally above 200 g/l and may be as high as 1500 g/l. It is particularly preferred that the bulk density of at least one particulate component will be greater than 700 g/l, preferably greater than 750 g/l or even above 800 g/l.

Generally speaking, the bulk density of blown powders produced by spray drying processes will be lower than the bulk density of other components such as agglomerates and other intermediates for example, the density of agglomerates and other intermediates may be from 500 or even above 600 g/l or above 700 g/l. In contrast, the bulk density of blown powder is generally from 150 g/l to 500 g/l or 600 g/l. More usually, the bulk density of blown powder is at least 300 g/l, but is generally no greater than 550 g/l after drying and ageing for at least 24 hours in ambient conditions. Thus, using feed streams comprising mixtures or blown powders and/or agglomerates and/or raw material ingredients or other co-compacted combinations of detergent ingredients will not only vary the chemical composition of the detergent particles produced, but will also vary the density. For example, particulate components comprising surfactant and builder may be added to raw materials comprising builder and binder comprising surfactant so that the binder and raw material contain builder and surfactant in the same weight ratios as in the pre-formed agglomerate, so that the chemical composition of the finally produced detergent granule will be the same, but the density will be either lower or higher than that of the pre-formed particulate component. Thus, combinations of the raw materials may be used to give a pre-set bulk density for the finished detergent granules. Thus, sophisticated control of the processing can be omitted.

Anionic Surfactant

The anionic surfactant herein preferably comprises at least a sulphate surfactant and a sulphonate surfactant, preferably comprising at least a $C_9$–$C_{14}$ alkyl benzene sulphonate salt. It may be preferred highly preferred that more than one sulphate surfactant is present, and hereby it is preferred that at least a branched alkyl surfactant is present. The anionic sulphate surfactant comprises preferably one or more $C_{12}$–$C_{24}$ linear alkyl sulphate salts and one or more branched $C_{12}$–$C_{24}$ alkyl sulphate salts, preferably in a ratio of from 1:5 to 5:1, preferably from 1:3 to 1:1.

Other possible anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulphonate Surfactant

The anionic sulphonate surfactants in accordance with the invention include the salts of $C_5$–$C_{20}$ linear or branched alkylbenzene sulphonates, alkyl ester sulphonates, $C_6$–$C_{22}$ primary or secondary alkane sulphonates, $C_6$–$C_{24}$ olefin sulphonates, sulphonated polycarboxylic acids, and any mixtures thereof.

Highly preferred is a $C_{12}$–$C_{16}$ linear alkylbenzene sulphonate. Preferred salts are sodium and potassium salts.

The alkyl ester sulphonated surfactant are also suitable for the invention, preferably those of formula:

$$R^1—CH(SO_3M)—(A)_x—C(O)—OR^2$$

wherein $R^1$ is a $C_6$–$C_{22}$ hydrocarbyl, $R^2$ is a $C_1$ –$C_6$ alkyl, A is a $C_6$–$C_{22}$ alkylene, alkenylene, is 0 or 1, and M is a cation. The counterion M is preferably sodium, potassium or ammonium.

The alkyl ester sulphonated surfactant is preferably a α-sulpho alkyl ester of the formula above, whereby thus x is 0. Preferably, $R^1$ is an alkyl or alkenyl group of from 10 to 22, preferably 16 C atoms and x is preferably 0. $R^2$ is preferably ethyl or more preferably methyl.

It can be preferred that the R1 of the ester is derived from unsaturated fatty acids, with preferably 1, 2 or 3 double bonds. It can also be preferred that $R^1$ of the ester is derived from a natural occurring fatty acid, preferably palmic acid or stearic acid or mixtures thereof.

Anionic Alkyl Sulphate Surfactant

The anionic sulphate surfactant herein include the linear and branched primary, but may also comprise secondary alkyl sulphates and disulphates, alkyl ethoxysulphates having an average ethoxylation number of 3 or below, fatty oleoyl glycerol sulphates, alkyl phenol ethylene oxide ether sulphates, the $C_5$–$C_{17}$ acyl-N-($C_1$–$C_4$ alkyl) and —N—($C_1$–$C_2$ hydroxyalkyl) glucamine sulphates, and sulphates of alkylpolysaccharides.

Primary alkyl sulphate surfactants are preferably selected from the linear and branched primary $C_{10}$–$C_{24}$ alkyl sulphates, more preferably the $C_{11}$–$C_{18}$ linear or branched chain alkyl sulphates, or even the $C_{12}$–$C_{14}$ linear chain alkyl sulphates.

Preferred secondary alkyl sulphate surfactant are of the formula:

$$R^3—CH(SO_4M)—R^4$$

wherein $R^3$ is a $C_8$–$C_{20}$hydrocycarbyl, $R^4$ is a hydrocycarbyl and M is a cation.

Alkyl ethoxy sulphate surfactants are preferably selected from the group consisting of the $C_{10}$–$C_{18}$ alkyl sulphates which have been ethoxylated with from 0.5 to 3 moles of ethylene oxide per molecule. More preferably, the alkyl ethoxysulphate surfactant is a $C_{11}$–$C_{18}$, most preferably $C_{11}$–$C_{15}$ alkyl sulphate which has been ethoxylated with from 0.5 to 3, preferably from 1 to 3, moles of ethylene oxide per molecule.

A particularly preferred aspect of the invention employs mixtures of the preferred alkyl sulphate and alkyl ethoxysulphate surfactants. Preferred salts are sodium and potassium salts.

Branched Anionic Surfactants

Preferred branched primary alkyl sulphate surfactants for use herein are of the formula:

$$CH_3CH_2(CH_2)_wCH(\overset{R}{\overset{|}{C}})(CH_2)_xCH(\overset{R^1}{\overset{|}{C}})(CH_2)_yCH(\overset{R^2}{\overset{|}{C}})(CH_2)_zOSO_3M.$$

These surfactants have a linear primary alkyl sulphate chain backbone (i.e., the longest linear carbon chain which includes the sulphated carbon atom) which preferably comprises from 12 to 19 carbon atoms and their branched primary alkyl moieties comprise preferably a total of at least 14 and preferably no more than 20, carbon atoms. In the surfactant system comprising more than one of these sulphate surfactants, the average total number of carbon atoms for the branched primary alkyl moieties is preferably within the range of from greater than 14.5 to about 17.5. Thus, the surfactant system preferably comprises at least one branched primary alkyl sulphate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

R, $R^1$, and $R^2$ are each independently selected from hydrogen and $C_1$–$C_3$ alkyl group (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

M is hydrogen or a salt forming cation depending upon the method of synthesis.

w is an integer from 0 to 13; x is an integer from 0 to 13; y is an integer from 0 to 13; z is an integer of at least 1: and w+x+y+z is an integer from 8 to 14.

A preferred mid-chain branched primary alkyl sulphate surfactant is a C16 total carbon primary alkyl sulphate surfactant having 13 carbon atoms in the backbone and having 1, 2, or 3 branching units (i.e., R, $R^1$ and/or $R^2$) of in total 3 carbon atoms, (whereby thus the total number of carbon atoms is at least 16). Preferred branching units can be one propyl branching unit or three methyl branching units.

Another preferred surfactant are branched primary alkyl sulphates having the formula:

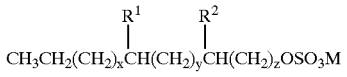

wherein the total number of carbon atoms, including branching, is from 15 to 18, and when more than one of these sulphates is present, the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11; y is from 0 to 11; z is at least 2; and x +y +z is from 9 to 13; provided $R^1$ and $R^2$ are not both hydrogen.

Dianionic Surfactants

The dianionic surfactants are also useful anionic surfactants for the present invention, in particular those of formula:

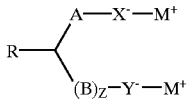

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from alkylene, alkenylene, (poly) alkoxylene, hydroxyalkylene, arylalkylene or amido alkylene groups of chain length $C_1$ to $C_{28}$ preferably $C_1$ to $C_5$, most preferably $C_1$ or $C_2$, or a covalent bond, and preferably A and B in total contain at least 2 atoms; A, B, and R in total contain from 4 to about 31 carbon atoms: X and Y are anionic groups selected from the group comprising carboxylate, and preferably sulphate and sulfonate, z is 0 or preferably 1; and M is a cationic moiety, preferably a substituted or unsubstituted ammonium ion, or an alkali or alkaline earth metal ion.

The most preferred dianionic surfactant has the formula as above where R is an alkyl group of chain length from $C_{10}$ to $C_{18}$, A and B are independently $C_1$ or $C_2$, both X and Y are sulphate groups, and M is a potassium, ammonium, or a sodium ion.

Preferred dianionic surfactants herein include:

(a) 3 disulphate compounds, preferably 1,3 C7–C23 (i.e., the total number of carbons in the molecule) straight or branched chain alkyl or alkenyl disulphates, more preferably having the formula:

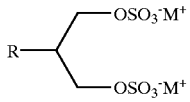

wherein R is a straight or branched chain alkyl or alkenyl group of chain length from about $C_4$ to about $C_{20}$:

(b) 1,4 disulphate compounds, preferably 1,4 C8–C22 straight or branched chain alkyl or alkenyl disulphates, more preferably having the formula:

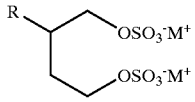

wherein R is a straight or branched chain alkyl or alkenyl group of chain length from about $C_4$ to about $C_{18}$; preferred R are selected from octanyl, nonanyl, decyl, dodecyl, tetradecyl, hexadecyl, octadecyl, and mixtures thereof, and (c) 1,5 disulphate compounds, preferably 1,5 C9–C23 straight or branched chain alkyl or alkenyl disulphates, more preferably having the formula:

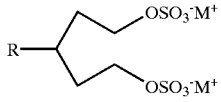

wherein R is a straight or branched chain alkyl or alkenyl group of chain length from about $C_4$ to about $C_{18}$.

It can be preferred that the dianionic surfactants of the invention are alkoxylated dianionic surfactants.

The alkoxylated dianionic surfactants of the invention comprise a structural skeleton of at least five carbon atoms, to which two anionic substituent groups spaced at least three atoms apart are attached. At least one of said anionic substituent groups is an alkoxy-linked sulphate or sulphonate group. Said structural skeleton can for example comprise any of the groups consisting of alkyl, substituted alkyl, alkenyl, aryl, alkaryl, ether, ester, amine and amide groups. Preferred alkoxy moieties are ethoxy, propoxy, and combinations thereof.

The structural skeleton preferably comprises from 5 to 32, preferably 7 to 28, most preferably 12 to 24 atoms. Preferably the structural skeleton comprises only carbon-containing groups and more preferably comprises only hydrocarbyl groups. Most preferably the structural skeleton comprises only straight or branched chain alkyl groups.

The structural skeleton is preferably branched. Preferably at least 10% by weight of the structural skeleton is branched and the branches are preferably from 1 to 5, more preferably from 1 to 3, most preferably from 1 to 2 atoms in length (not including the sulphate or sulphonate group attached to the branching).

A preferred alkoxylated dianionic surfactant has the formula:

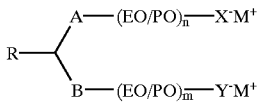

where R is an optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from, optionally substituted, alkyl and alkenyl group of chain length $C_1$ to $C_{28}$, preferably $C_1$ to $C_5$, most preferably $C_1$ or $C_2$, or a covalent bond; EO/PO are alkoxy moieties selected from ethoxy, propoxy, and mixed ethoxy/propoxy groups, wherein n and m are independently within the range of from about 0 to about 10, with at least m or n being at least 1; A and B in total contain at least 2 atoms; A. B, and R in total contain from 4 to about 31 carbon atoms; X and Y are anionic groups selected from the group consisting of sulphate and sulphonate, provided that at least one of X or Y is a sulfate group; and M is a cationic moiety, preferably a substituted or unsubstituted ammonium ion, or an alkali or alkaline earth metal ion.

The most preferred alkoxylated dianionic surfactant has the formula as above where R is an alkyl group of chain length from $C_{10}$ to $C_{18}$, A and B are independently $C_1$ or $C_2$, n and m are both 1, both X and Y are sulfate groups, and M is a potassium, ammonium, or a sodium ion.

Preferred alkoxylated dianionic surfactants herein include: ethoxylated and/or propoxylated disulphate compounds, preferably C10–C24 straight or branched chain alkyl or alkenyl ethoxylated and/or propoxylated disulphates, more preferably having the formulae:

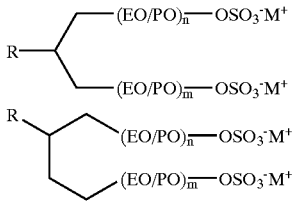

and wherein R is a straight or branched chain alkyl or alkenyl group of chain length from about C6 to about $C_{18}$; EO/PO are alkoxy moieties selected from ethoxy, propoxy, and mixed ethoxy/propoxy groups; and n and m are independently within the range of from about 0 to about 10 (preferably from about 0 to about 5), with at least m or n being 1.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group,x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressors.

Alkali Metal Sarcosinate Surfactant

Other suitable anionic surfactants are the alkali metal sarcosinates of formula $R—CON\ (R^1)\ CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Aluminosilicate

Suitable aluminosilicates herein are zeolites which have the unit cell formula $Na_z[(AlO_2)_z(SiO_2)y].\ xH_2O$ wherein z and y are at least 6; the molar ratio of z to y is from 1.0 to 0.5 and x is at least 5, preferably from 7.5 to 276, more preferably from 10 to 264. The aluminosilicates are in preferably in hydrated form and are preferably crystalline, containing from 10% to 28%, more preferably from 18% to 22% water in bound form. However, it may be useful to incorporate overdried aluminosilictaes.

The aluminosilicates can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276\ H_2O$.

The preferred crystalline layered silicate herein have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. M is preferably H, K or Na or mixtures thereof, preferably Na. The most preferred material is $\alpha$-$Na_2Si_2O_5$, $\beta$-$Na_2Si_2O_5$ or $\delta$-$Na_2Si_2O_5$, or mixtures thereof, preferably being $Na_2Si_2O_5$, for example available from Clariant as NaSKS-6.

The crystalline layered silicate material, in particular of the formula $Na_2Si_2O_5$ may optionally comprise other elements such as B, P, S, for example obtained by processes as described in EP 578986-B.

The crystalline layered silicate may be in an intimate mixture with other materials, including one or more of surfactants of the surfactant system herein.

Also preferred may be small levels of other silicate material, including amorphous silicate, meta silicates, as described herein.

Water-Soluble Builders

The preferably comprises one or more water-soluble or partially water-soluble builders.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms and mixtures of any of the foregoing.

The carboxylate or polycarboxylate builder can be momomeric or oligomeric in type although monomeric polycarboxylates are generally preferred for reasons of cost and performance. In addition to these water-soluble builders, polymeric polycarboxyltes may be present, including homo and copolymers of maleic acid and acrylic acid and their salts.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, malcic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1.387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439.000. Preferred polycarboxylates are hydroxycarboxylates containing up to three carboxy groups per molecule, more particularly citrates.

Most preferred may be citric acid, malic acid, and fumaric acid, or their salts or mixtures thereof.

The parent acids of the monomeric or oligomeric polycarboxylate chelating agents or mixtures thereof with their salts, e.g. citric acid or citrate/citric acid mixtures, are also contemplated as useful builder ingredients.

Effervescence System

Preferably, an effervesce source is present in the granule or tablet of the invention. Any effervescence system known in the art can be useful in the granule or tablet or ingredients of the invention to provide even better dispensing and dissolution of the granule or tablet. A preferred effervescence system comprises an acid source, capable of reacting with an alkali source in the presence of water to produce a gas.

The acid source is preferably present at a level of from 0.5% o 351%, more preferably from 1.0% or even 2% to 20% or even form 4% to 20% by weight of the granule or tablet.

It may be preferred that the acid source or part thereof and the alkali source or part thereof are comprised in an intimate mixture, for example in the form of a compacted particle. The molecular ratio of the acid source to the alkali source, is preferably from 50:1 to 1:50, more preferably from 20:1 to 1:20 more preferably from 10:1 to 1:10, whereby when an intimate mixture of the acid source and the alkali source is present, this ratio is more preferably from 5:1 to 1:3, more preferably from 3:1 to 1:2, more preferably from 2:1 to 1:2.

The acid source may be any organic, mineral or inorganic acid, or a derivative thereof, or a mixture thereof. Preferably the acid source comprises an organic acid.

The acid compound is preferably substantially anhydrous or non-hygroscopic and the acid is preferably water-soluble. It may be preferred that the acid source is overdried.

Suitable acids sources include citric, malic, maleic, fumaric, aspartic, glutaric, tartaric succinic or adipic acid, monosodium phosphate, boric acid, or derivative thereof. Citric acid, maleic or malic acid are especially preferred.

Most preferably, the acid source provides acidic compounds which have an average particle size in the range of from about 75 microns to 1180 microns, more preferably from 150 microns to about 710 microns, calculated by sieving a sample of the source of acidity on a series of Tyler sieves.

As discussed above, the effervescence system preferably comprises an alkali source, however, for the purpose of the invention, it should be understood that the alkali source may be part of the effervescence particle or can be incorporated in the granule or tablet of the invention separately.

Any alkali source which has the capacity to react with the acid source to produce a gas may be present in the particle, which may be any gas known in the art, including nitrogen oxygen and carbondioxide gas. Preferred can be perhydrate bleaches, including perborate, and silicate material. The alkali source is preferably substantially anhydrous or non-hygroscopic. It may be preferred that the alkali source is overdried.

Preferably this gas is carbon dioxide, and therefore the alkali source is a preferably a source of carbonate, which can be any source of carbonate known in the art. In a preferred embodiment, the carbonate source is a carbonate salt. Examples of preferred carbonates are the alkaline earth and alkali metal carbonates, including sodium or potassium carbonate, bicarbonate and sesqui-carbonate and any mixtures thereof with ultra-fine calcium carbonate such as are disclosed in German Patent Application No. 2,321,001 published on Nov. 15, 1973. Alkali metal percarbonate salts are also suitable sources of carbonate species, which may be present combined with one or more other carbonate sources.

The carbonate and bicarbonate preferably have an amorphous structure. The carbonate and/or bicarbonates may be coated with coating materials. It can be preferred that the particles of carbonate and bicarbonate can have a mean particle size of 75 microns or preferably 150 $\mu$m or greater, more preferably of 250 $\mu$m or greater, preferably 500 $\mu$m or greater. It may be preferred that the carbonate salt is such that fewer than 20% (by weight) of the particles have a particle size below 500 μm, calculated by sieving a sample of the carbonate or bicarbonate on a series of Tyler sieves. Alternatively or in addition to the previous carbonate salt, it may be preferred that the fewer than 60% or even 25% of the particles have a particle size below 150 μm, whilst fewer than 5% has a particle size of more than 1.1 8 mm, more preferably fewer than 20% have a particle size of more than 212 μm, calculated by sieving a sample of the carbonate or bicarbonate on a series of Tyler sieves.

Additional Ingredients

The granule or tablet and the components thereof may contain additional detergent actives. The precise nature of these additional ingredients, and levels of incorporation thereof will depend on the physical form of the granule or tablets comprising the builder ingredient and the precise nature of the washing operation for which it is to be used.

Additional ingredients include additional builders, additional surfactants, bleach, enzymes, suds suppressors, lime soap, dispersants, soil suspension and anti-redeposition agents soil releasing agents, perfumes, brighteners, photobleaching agents and additional corrosion inhibitors.

Highly preferred are disintegrating aids, such as water-swellable polymers or clays and wicking agents, which help rupture of the granule or tablet structure.

Alkoxylated Nonionic Surfactant

Essentially any alkoxylated nonionic surfactants are suitable herein. The ethoxylated and propoxylated nonionic surfactants are preferred. However, as set out above it may be preferred that only limited amounts of nonionic surfactant is used in the granules or tablets herein.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565.647. Llenado, issued Jan. 21, 1986, having a hydrophobic group containing from 6 to 30 carbon atoms and a polysaccharide, e.g. a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms: n is 2 or 3; t is from 0 to 10, and x is from 1.3 to 8. The glycosyl is preferably derived from glucose.

Cationic Surfactants

Suitable cationic surfactants to be used in the detergent herein include the quatemary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent granule or tablets or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

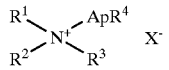

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups, $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula:

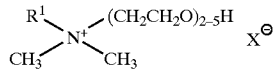

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EQ and/or Pr and/or i-Pr units.

The levels of the cationic mono-alkoxylated amine surfactants used in detergent granule or tablets of the invention is preferably from 0.1% to 20%, more preferably from 0.2% to 7%, most preferably from 0.3% to 3.0% by weight of the granule or tablet.

Cationic Bis-Alkoxylated Amine Surfactant

The cationic bis-alkoxylated amine surfactant preferably has the general formula II:

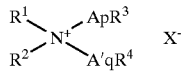

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e. $—CH_2CH_2O—$), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula:

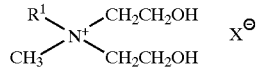

wherein $R_1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

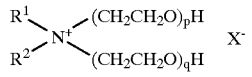

wherein $R_1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

A highly preferred additional ingredient of the granule or tablets or component herein is an oxygen bleach, preferably comprising a hydrogen peroxide source and a bleach precursor or activator.

A preferred source of hydrogen peroxide is a perhydrate bleach, such as metal perborates, more preferably metal percarbonates, particularly the sodium salts. Perborate can be mono or tetra hydrated. Sodium percarbonate has the formula corresponding to $2Na_2CO_3.3H_2O_2$, and is available commercially as a crystalline solid.

In particular the percarbonate salts are preferably coated. Suitable coating agent are known in the art, and include silicates, magnesium salts and carbonates salts.

Potassium peroxymonopersulfate. sodium per is another optional inorganic perhydrate salt of use in the detergent granule or tablets herein.

Organic Peroxyacid Bleaching System

A preferred feature of the granule or tablet or even components herein is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the granule or tablet. Granule or tablets or particulate components containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

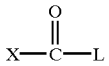

where L is a leaving group and X is essentially any functionality, such that on perhydrolysis the structure of the peroxyacid produced is

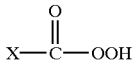

Peroxyacid bleach precursor compounds are preferably incorporated at a level of from 0.5% to 20% by weight, more preferably from 1% to 15% by weight, most preferably from 1.5% to 10% by weight of the detergent granule or tablets.

Suitable peroxyacid bleach precursor compounds typically contain one or more N— or O— acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching granule or tablet.

Preferred L groups are selected from the group consisting of:

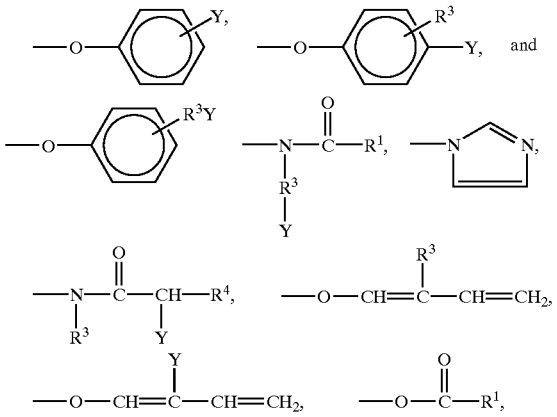

-continued

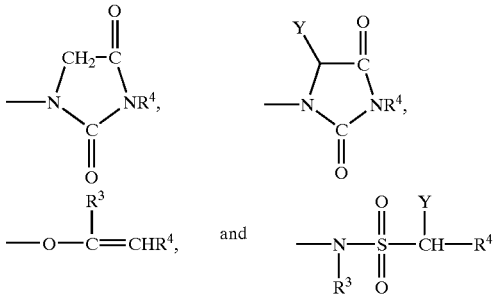

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$ and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^{30}$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent granule or tablet, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

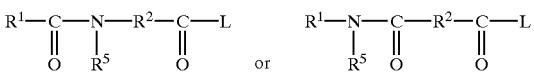

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L .can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The detergent granule or tablet may contain, in addition to, or as an alternative to, an organic peroxyacid bleach precursor compound, a preformed organic peroxyacid, typically at a level of from 1% to 15% by weight, more preferably from 1% to 10% by weight of the granule or tablet.

A preferred class of organic peroxyacid compounds are the amide substituted compounds of the following general formulae:

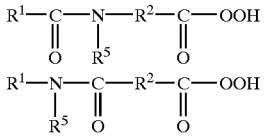

or wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Heavy Metal Ion Sequestrant

Heavy metal ion sequestrant are also useful additional ingredients herein. By heavy metal ion sequestrant it is meant herein ingredients which act to sequester (chelate) heavy metal ions. These ingredients may also have a limited calcium and magnesium chelation capacity, but preferentially they show selectivity to binding heavy metal ions such as iron, manganese and copper. The are thus not considered builders for the purpose of the invention.

Heavy metal ion sequestrants are generally present at a level of from 0.005% to 10%, preferably from 0.1% to 5%, more preferably from 0.25% to 7.5% and most preferably from 0.3% to 2% by weight of the granule or tablets.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutanic acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent granule or tablets. Suitable enzymes arc discussed in U.S. Pat. Nos. 3,519.570 and 3.533,139.

Organic Polymeric Compound

Organic polymeric compounds, not being the polymeric polycarboxylic acid or salts thereof described above, are preferred additional ingredients of the granule or tablets herein.

By organic polymeric compound it is meant herein essentially any polymeric organic compound commonly used as binder, dispersants, and anti-redeposition and soil suspension agents in detergent granule or tablets, including any of the high molecular weight organic polymeric compounds described as clay flocculating agents herein, including quatemised ethoxylated (poly) amine clay-soil removal/anti-redeposition agent.

Organic polymeric compound is typically incorporated in the detergent granule or tablets of the invention at a level of from 0.01% to 30%, preferably from 0.1% to 15%, most preferably from 0.5% to 10% by weight of the granule or tablets.

Other organic polymeric compounds suitable for incorporation in the detergent granule or tablets herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric ingredients herein are cotton and non-cotton soil release polymer according to U.S. Pat. No. 4,968,451, Scheibel et al., and U.S. Pat. No. 5,415,807, Gosselink et al., and in particular according to U.S. application No. 60/051517.

Another organic compound, which is a preferred clay dispersant/anti-redeposition agent, for use herein, can be the ethoxylated cationic monoamines and diamines of the formula:

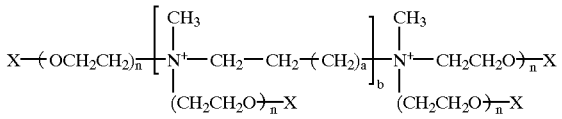

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0, for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-01 1965 and U.S. Pat. No. 4,659,802 and U.S. Pat. No. 4,664,848.

Suds Suppressing System

The detergent granule or tablets or components thereof, when formulated for use in machine washing granule or tablets, may comprise a suds suppressing system present at a level of from 0.01% to 15%, preferably from 0.02% to 10%, most preferably from 0.05% to 3% by weight of the granule or tablet.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent granule or tablet, particularly in the presence of agitation of that solution.

Particularly preferred antifoam compounds for use herein are silicone antifoam compounds defined herein as any antifoam compound including a silicone ingredient. Such silicone antifoam compounds also typically contain a silica ingredient. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Coming under the tradename DC0544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The granule or tablets or components herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The granule or tablets herein also optionally contain from about 0.005% to 5% by weight of certain types of hydrophilic optical brighteners, as known in the art, preferred may be that a mixture of brighteners is used, for example one brightener on the surface of the tablet or granule and another in the core of the tablet or granule.

Polymeric Soil Release Agent

Polymeric soil release agents, hereinafter "SRA", can optionally be employed in the present granule or tablets. If utilized, SRA's will generally comprise from 0.01% to 10.0%, typically from 0.1% to 5%, preferably from 0.2% to 3.0% by weight, of the granule or tablets.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomenzation, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. 4,711,730, Dec. 8, 1987 to Gosselink et al., for example those produced by transesterification/oligomerization of poly-(ethyleneglycol) methyl ether, DMT, PG and poly (ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester granule or tablet made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959.230 to Hays, May 25. 1976 and U.S. Pat. No. 3.893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the granule or tablets of the invention include perfumes, speckles, colours or dyes. Also, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Highly preferred are encapsulated perfumes, preferably comprising a starch encapsulte.

Abbreviations Used in Examples

In the detergent granule or tablets, the abbreviated ingredient identifications have the following meanings:

LAS: Sodium linear $C_{11-13}$ alkyl benzene sulfonate

LAS: (I) Flake containing sodium linear $C_{11-13}$ alkyl benzene sulfonate (90%) and sodium sulphate and moisture LAS(II): Potassium linear $C_{11-13}$ alkyl benzene sulfonate MES: C-sulpho methylester of $C_{18}$ fatty acid TAS: Sodium tallow alkyl sulfate CxyAS: Sodium $C_{1x}$–$C_{1y}$ alkyl sulfate C46SAS: Sodium $C_{14}$–$C_{16}$ secondary (2,3) alkyl sulfate CxyEzS: Sodium $C_{1x}$–$C_{1y}$ alkyl sulfate condensed with z moles of ethylene oxide CxyEz: $C_{1x}$–$C_{1y}$ predominantly linear primary alcohol condensed with an average of z moles of ethylene oxide QAS: $R_2.N^+(CH_3)_2(C_2H_4OH)$ with $R_2=C_{12}$–$C_{14}$ QAS 1: $R_2.N^+(CH_3)_2(C_2H_4OH)$ with $R_2=C_8$–$C_{11}$ SADS: Sodium $C_{14}$–$C_{22}$ alkyl disulfate of formula 2-(R).$C_4H_7$.-1,4-$(SO_4—)_2$ where R=$C_{10}$-$C_{18}$ SADE2S: Sodium $C_{14}$-$C_{22}$ alkyl disulfate of formula 2-(R).$C_4H_7$.-1,4-($SO_4$—)$_2$ where R=$C_{10}$–$C_{18}$, condensed with z moles of ethylene oxide APA: $C_8$–$C_{10}$ amido propyl dimethyl amine Soap: Sodium linear alkyl carboxylate derived from an 80/20 mixture of tallow and coconut fatty acids STS: Sodium toluene sulphonate CFAA: $C_{12}$–$C_{14}$ (coco) alkyl N-methyl glucamide TFAA: $C_{16}$–$C_{18}$ alkyl N-methyl glucamide TPKFA: $C_{16}$–$C_{18}$ topped whole cut fatty acids STPP: Anhydrous sodium tripolyphosphate TSPP: Tetrasodium pyrophosphate Zeolite A: Hydrated sodium aluminosilicate of formula $Na_{12}(AlO_2SiO_2)_{12}.27H_2O$ having a primary particle size in the range from 0.1 to 10 micrometers (weight expressed on an anhydrous basis)

NaSKS-6 (1): Crystalline layered silicate of formula δ-$Na_2Si_2O_5$ of weight average particle size of 18 microns and at least 90% by weight being of particle size of below 65.6 microns.

NaSKS-6 (II): Crystalline layered silicate of formula δ-$Na_2Si_2O_5$ of weight average particle size of 18 microns and at least 90% by weight being of particle size of below 42.1 microns.

Citric acid: Anhydrous citric acid

Borate: Sodium borate

Carbonate: Anydrous sodium carbonate with a particle size between 200 μm and 900 μm Bicarbonate: Anhydrous sodium bicarbonate with a particle size distribution between 400 μm and 1200 μm Silicate: Amorphous sodium silicate ($SiO_2$:$Na_2O$=2.0:1)

Sulfate: Anhydrous sodium sulfate

Mg sulfate: Anhydrous magnesium sulfate

Citrate: Tri-sodium citrate dihydrate of activity 86.4% with a particle size distribution between 425μm and 850μm MA/AA: Copolymer of 1:4 maleic/acrylic acid, average molecular weight about 70,000

MA/AA (1): Copolymer of 4:6 maleic/acrylic acid, average molecular weight about 10,000

AA: Sodium polyacrylate polymer of average molecular weight 4,500

CMC: Sodium carboxymethyl cellulose

Cellulose ether: Methyl cellulose ether with a degree of polymerization of 650 available from Shin Etsu Chemicals Protease: Proteolytic enzyme, having 3.3% by weight of active enzyme, sold by NOVO Industries A/S under the tradename Savinase Protease I: Proteolytic enzyme, having 4% by weight of active enzyme, as described in WO 95/10591, sold by Genencor Int. Inc.

Alcalase: Proteolytic enzyme, having 5.3% by weight of active enzyme, sold by NOVO Industries A/S Cellulase: Cellulytic enzyme, having 0.23% by weight of active enzyme, sold by NOVO Industries A/S under the tradename Carezyme Amylase: Amylolytic enzyme, having 1.6% by weight of active enzyme, sold by NOVO Industries A/S under the tradename Termamyl 120T Amylase II: Amylolytic enzyme, as disclosed in PCT/US9703635 now WO 97/32961

Lipase: Lipolytic enzyme, having 2.0% by weight of active enzyme, sold by NOVO Industries A/S under the tradename Lipolase Lipase (I): Lipolytic enzyme, having 2.0% by weight of active enzyme, sold by NOVO Industries A/S under the tradename Lipolase Ultra Endolase: Endoglucanase enzyme, having 1.5% by weight of active enzyme, sold by NOVO Industries A/S PB4: Sodium perborate tetrahydrate of nominal formula $NaBO_2.3H_2O.H_2O_2$ PB1: Anhydrous sodium perborate bleach of nominal formula $NaBO_2.H_2O_2$ Percarbonate: Sodium percarbonate of nominal formula $2Na_2CO_3.3H_2O_2$ DOBS: Decanoyl oxybenzene sulfonate in the form of the sodium salt DPDA: Diperoxydodecanedioc acid NOBS: Nonanoyloxybenzene sulfonate in the form of the sodium salt NACAOBS: (6-nonamidocaproyl) oxybenzene sulfonate LOBS: Dodecanoyloxybenzene sulfonate in the form of the sodium salt DOBS: Decanoyloxybenzene sulfonate in the form of the sodium salt DOBA: Decanoyl oxybenzoic acid TAED: Tetraacetylethylenediamine DTPA: Diethylene triamine pentaacetic acid DTPMP: Diethylene trnamine penta (methylene phosphonate), marketed by Monsanto under the Tradename Dequest 2060

EDDS: Ethylenediamine-N,N'-disuccinic acid, (S,S) isomer in the form of its sodium salt.

Photoactivated bleach: Sulfonated zinc phthlocyanine or sulfonated alumino phthlocyanine encapsulated in or carried by a soluble polymer Brightener 1: Disodium 4,4'-bis(2-sulphostyryl)biphenyl Brightener 2: Disodium 4,4'-bis(4-anilino-6-morpholino-1.3.5-triazin-2-yl)amino) stilbene-2:2'-disulfonate HEDP: 1,1-hydroxyethane diphosphonic acid PEGx: Polyethylene glycol, with a molecular weight of x (typically 4.000)

PEO: Polyethylene oxide, with an average molecular weight of 50,000

TEPAE: Tetraethylenepentaamine ethoxylate

PVI: Polyvinyl imidosole, with an average molecular weight of 20,000

PVP: Polyvinylpyrolidone polymer, with an average molecular weight of 60,000

PVNO: Polyvinylpyridine N-oxide polymer, with an average molecular weight of 50,000

PVPVI: Copolymer of polyvinylpyrolidone and vinylimidazole, with an average molecular weight of 20,000

QEA: bis(($C_2H_5O$)($C_2H_4O$)$_n$)($CH_3$)—$N^+$—$C_6H_{12}$—$N^+$—($CH_3$) bis(($C_2H_5O$)—($C_2H_4O$))$_n$, wherein n=from 20 to 30

SRP 1: Anionically end capped poly esters

SRP 2: Diethoxylated poly (1,2 propylene terephtalate) short block polymer

PEI: Polyethyleneimine with an average molecular weight of 1800 and an average ethoxylation degree of 7 ethyleneoxy residues per nitrogen Silicone antifoam: Polydimethylsiloxane foam controller with siloxane-oxyalkylene copolymer as dispersing agent with a ratio of said foam controller to said dispersing agent of 10:1 to 100:1

Opacifier: Water based monostyrene latex mixture, sold by BASF Aktiengesellschaft under the tradename Lytron 621

Wax: Paraffin wax

EXAMPLE I

The following example relates to a granule or tablet which is formed of the individually listed blown powders and agglomerates and dry-adds, mixed together and bound together with the exemplified binding agents, following any of the processes as described herein. The granules are preferably made by fluidised bed agglomeration.

The spray-on ingredient is sprayed onto the granule or tablet.

In addition to the ingredients below, he exemplified tablets and granules may be coated with a coating agent to protect it from breaking or abrasion, water, temperature changes, and/or to help disintegration of the tablet or granule.

| | A | B | C | D | E | F | G | H | I |
|---|---|---|---|---|---|---|---|---|---|
| Blown powder | | | | | | | | | |
| LAS | 2.5 | 2.0 | 3.0 | 8.0 | 10.0 | 1.0 | — | — | — |
| MBAS | — | — | — | 1.0 | — | — | — | — | — |
| $C_{45}AE_3S$ | — | — | — | 1.0 | — | — | — | — | — |
| QAS | — | 1.0 | — | 1.0 | — | — | — | — | — |
| DTPA, HEDP and/ or EDDS | 0.3 | 0.3 | — | 0.3 | — | — | — | — | — |
| MgSO4 | 0.5 | 0.5 | — | — | — | 0.5 | — | — | — |
| Sodium citrate/citric acid | — | — | — | 3.0 | 5.0 | — | — | — | — |
| Sodium carbonate | 10.0 | 7.0 | 15.0 | — | 5.0 | 10.0 | — | — | — |
| Sodium sulphate | 5.0 | 5.0 | — | 5.0 | 5.0 | 3.0 | — | — | — |
| Sodium silicate 1.6R | — | — | — | — | 2.0 | 2.0 | — | — | — |
| Zeolite A | 20.0 | 20.0 | — | — | 1.0 | 22.0 | — | — | — |
| SKS-6 | — | 2.0 | — | — | — | 5.0 | — | — | — |
| MA/AA or AA | 1.0 | 1.0 | 11.0 | — | — | — | — | — | — |
| PEG 4000 | 0.5 | 2.0 | — | 1.0 | 0.5 | 1.0 | — | — | — |
| QEA | — | — | — | — | 1.0 | 1.0 | — | — | — |
| Brightener | 0.05 | 0.1 | 0.1 | — | 0.05 | — | — | — | — |
| Silicone oil | 0.01 | 0.01 | 0.02 | — | — | 0.05 | — | — | — |
| Agglomerate | | | | | | | | | |
| AS | 2.5 | 2.0 | 8.5 | — | 4.0 | 2.0 | — | 2.0 | 4.0 |
| MBAS | 6.5 | 2.0 | 7.0 | 4.0 | — | 3.0 | 12 | 5.0 | 1.0 |
| $C24AE_3$ | — | — | — | — | — | — | — | 1.0 | 0.5 |
| Carbonate | — | — | — | — | — | 1.0 | 1.0 | 1.0 | — |
| Sodium citrate/citric acid | — | — | — | — | 1.0 | — | — | 1.0 | 3.0 |
| CFAA | — | — | — | | — | 2.0 | — | — | 2.0 |
| QAS | — | — | — | — | — | 1.0 | — | — | 1.0 |
| QEA | — | 0.7 | — | — | — | 2.0 | 2.0 | — | — |
| SRP | — | 1.0 | — | — | — | 1.0 | 1.0 | 0.2 | — |
| Zeolite A | 15.0 | 15.0 | — | 10.0 | — | 7.0 | 6.0 | — | — |
| Sodium silicate | — | — | — | — | — | 3.0 | 2.0 | — | — |
| PEG | 0.5 | 0.5 | 1.0 | — | — | — | 1.0 | — | — |
| Agglomerates | | | | | | | | | |
| SKS-6 | — | — | — | — | 6.0 | — | — | 7.0 | — |
| AS | — | — | — | — | 5.0 | — | — | 10.0 | — |
| Dry-add particulate ingredients | | | | | | | | | |
| (40:20:40) | 10.0 | 10.0 | 10.0 | 4.0 | — | — | 2.0 | 2.0 | 7.0 |
| NACAOBS | — | 3.0 | — | 1.5 | — | — | — | 4.5 | — |
| NOBS | 3.0 | — | 3.0 | — | — | — | — | — | 5.0 |
| TAED | | 2.5 | — | 1.5 | 5.5 | — | — | — | — |
| LAS (I) | — | 3.0 | — | — | — | — | 2.0 | 5.0 | — |
| Citrate | — | — | — | — | — | 5.0 | 1.0 | — | 5.0 |
| Percarbonate | 15.0 | 10.0 | 6.0 | 18.0 | — | — | — | 18.0 | 5.0 |
| Perborate | — | — | — | — | 6.0 | — | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | — | 0.5 | — | 0.2 |
| softening clay | — | — | — | 10.0 | — | 7.0 | — | — | — |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | — | 0.3 | 3.0 | — | — | — | 0.3 | — |
| Dyed carbonate (blue, green) | 0.5 | 0.5 | 1.0 | 2.0 | — | — | 0.5 | 0.5 | 1.0 |
| Binding agent | | | | | | | | | |
| water | 5.0 | 3.0 | 5.0 | 3.0 | — | — | 4.0 | — | — |
| AE3, AE5 or AE7 | — | — | — | | 2.0 | 2.0 | — | — | — |

-continued

| | A | B | C | D | E | F | G | H | I |
|---|---|---|---|---|---|---|---|---|---|
| PVP or PEG | — | — | — | 2.0 | — | 2.0 | — | — | — |
| MBAS | — | — | — | — | — | — | 1.0 | — | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| Perfume | — | 0.5 | — | 0.8 | — | 0.5 | — | 0.5 | — |
| Fillers up to 100% | | | | | | | | | |

What is claimed is:

1. A detergent granule or tablet comprising an anionic surfactant system and no nonionic surfactant wherein said anionic surfactant system comprises an anionic sulphate surfactant and an anionic sulphonate surfactant, the granule or the tablet comprising at least a first and a second particulate component and a binding agent, characterized in that the first particulate component comprises an anionic sulphate surfactant, no anionic sulphonate surfactant, and wherein said first particulate component is free of inorganic carbonate salt and the second particulate component comprises an anionic sulphonate surfactant, an inorganic carbonate salt, no aluminosilicate and no anionic sulphate surfactant.

2. A detergent granule or tablet according to claim 1 whereby no particulate components comprises both anionic sulphate surfactant and anionic sulphonate surfactant.

3. A detergent granule or tablet according to claim 1 whereby the first particulate component comprises an anionic sulphate surfactant and a carrier material and the second particulate component comprises a carrier material and an anionic sulphonate surfactant.

4. A detergent granule or tablet according to claim 3 whereby the first particulate component comprises a carrier material selected from the group consisting of inorganic salts, water-soluble builder material, water-insoluble builder material, and mixtures thereof.

5. A detergent granule or tablet according to claim 3 whereby the second particulate component comprises a carrier material selected from the group consisting of inorganic salts, water-insoluble builder material, and mixtures thereof.

6. A detergent granule or tablet according to claim 1, comprising a polymeric builder material provided that when the polymeric builder material is present in a particulate component or binding agent comprising an anionic surfactant, the ratio of the anionic surfactant to polymeric builder material is less than 1:3 or more than 3:1.

7. A detergent granule or tablet according to claim 1 whereby the binding agent comprises an anionic sulphate surfactant, polymeric material or mixtures thereof.

8. A detergent granule or tablet according to claim 1 comprising a particulate component comprising at least 90% by weight of the component of an anionic sulphonate surfactant.

9. A detergent granule or tablet according to claim 1 whereby the anionic sulphonate surfactant comprises a salt of a linear or branched $C_9$–$C_{14}$ alkyl benzene sulphonate.

10. A detergent granule or tablet according to claim 1 whereby the anionic sulphate surfactant comprises one or more $C_{12}$–$C_{24}$ linear alkyl sulphate salts and one or more branched $C_{12}$–$C_{24}$ alkyl sulphate salts in a ratio of from 1:5 to 5:1.

11. A detergent granule or tablet according to claim 1 comprising one or more additional particulate components or additional ingredients, selected from the group consisting of enzymes, perfumes, bleaching agent, effervescence systems, suds suppressors, brighteners and coating agents.

12. A process for making a granule or tablet according to claim 1 whereby at least two particulate components are mixed with a binding agent.

13. A process for making a granule or tablet according to claim 1 whereby at least two particulate components and a binding agent are mixed in a moderate to low shear mixing step characterized in that die ratio of anionic sulphate surfactant to anionic sulphonate surfactant in the binding agent, is less than 1:4 or more than 4:1.

14. A process according to claim 13 in which the mixing step is a low shear mixing step which takes place in a pan granulator, drum mixer or fluidized bed or a moderate shear mixing step which takes place in a moderate speed mixer.

15. A process according to claim 14 in which a binding agent is added during or immediately preceding the mixing step.

16. A process according to claim 15 in which the binding agent or part thereof is present in the detergent particle and comprises water or an aqueous solution of surfactant having a concentration below 25% by weight.

17. A detergent composition comprising from 80–100% by weight of the composition of the granule according to claim 11.

* * * * *